United States Patent [19]

Rubin

[11] Patent Number: 4,519,110

[45] Date of Patent: May 28, 1985

[54] BRUSH

[76] Inventor: Matvei Rubin, 89-11 63 Dr., Rego Park, N.Y. 11374

[21] Appl. No.: 569,497

[22] Filed: Jan. 9, 1984

[51] Int. Cl.[3] ..... A46B 9/02

[52] U.S. Cl. ..... 15/159 R; 15/159 A; 40/314; D4/124

[58] Field of Search ..... 15/159 R, 159 A, 160, 15/201, DIG. 5, DIG. 6, 172, 217; D4/33, 34, 35; D6/582–591; 40/314; 132/85, 84 R–84 D

[56] References Cited

U.S. PATENT DOCUMENTS

| | | | |
|---|---|---|---|
| 227,115 | 5/1880 | Lawrence | 15/217 |
| 1,958,134 | 5/1934 | Dike | 15/160 |
| 3,253,292 | 5/1966 | Herschensohn | 15/201 |
| 3,346,901 | 10/1967 | Fay | 15/160 |
| 4,030,158 | 6/1977 | Blair et al. | 15/DIG. 5 |

FOREIGN PATENT DOCUMENTS

| | | | |
|---|---|---|---|
| 855906 | 11/1970 | Canada | 15/172 |
| 39918 | 6/1907 | Switzerland | 15/DIG. 5 |
| 265359 | 2/1927 | United Kingdom | 15/160 |

*Primary Examiner*—Peter Feldman
*Attorney, Agent, or Firm*—Ilya Zborovsky

[57] ABSTRACT

A brush has a supporting portion and a plurality of bristles which are arranged in sets at distances from one another so as to form letters, numerals and the like.

7 Claims, 4 Drawing Figures

BRUSH

BACKGROUND OF THE INVENTION

The present invention relates to a brush for brushing hair. It can also be used for brushing clothes and the like.

Brushes are manufactured in large quantities and widely used. The known brushes have a supporting portion and a plurality of bristles arranged on it. In the known brushes the bristles are arranged in an uninterrupted layer. This not only requires a high consumption of bristles, but also does not provide for a possibility to personalize the brush and to make it more attractive by forming special designs.

SUMMARY OF THE INVENTION

Accordingly, it is an object of the present invention to provide a brush which avoids the disadvantages of the prior art.

In keeping with these objects and with others, the brush of the invention has bristles which are arranged so that they form letters, numerals and the like.

When the brush is designed in accordance with the present invention, it provides for economy of bristles and at the same time can be provided with names, symbols etc. to personalize the brush or to make it more attractive in other ways.

The novel features of the invention are set forth in the appended claims. The invention itself will be best understood from the following description which is accompanied by the following drawing.

DESCRIPTION OF PREFERRED EMBODIMENTS

Figure 3:
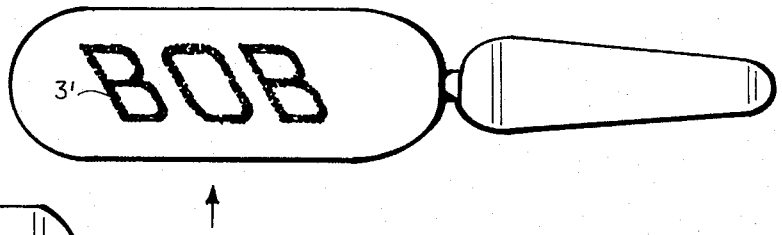
FIGS. 3 and 4 are views showing two further embodiments of the brush in accordance with the present invention.

A brush in accordance with the present invention has a supporting portion 1 and a holding portion 2. The supporting portion has a surface arranged to face toward a user, and a plurality of bristles 3 which form letters, numerals etc, preferably in a meaningful combination, like names, words, numbers, symbols etc. As can be seen from the drawing, the letters, numerals and the like 3 are arranged at some distances from one another and have hollow spaces inside their contours, so as to simultaneously economize the bristles.

One or two rows of additional bristles 4 are provided at one or two sides of the bristles 3, as considered in a longitudinal direction. The letters, numerals and the like are spaced from one another in a longitudinal direction. However, it is also possible that the letters, numerals and the like 3 are spaced from one another in the transverse direction. The additional rows of bristles 4 form a continuous line in the longitudinal direction. Therefore the brushing effect is not reduced because of the distances between the letters, numerals, and the like.

It is to be understood that the letters, numerals and the like 3' can be provided without the additional rows of bristles. In this case it is advantageous to make the letters, numerals and the like inclined so that when seen in the direction of the arrow in FIG. 3 the bristles form an uninterrupted longitudinal line. This not only increases the attractiveness of the brush, but also when brushing in the transverse direction, completely overlaps the area to be brushed.

Figure 4:
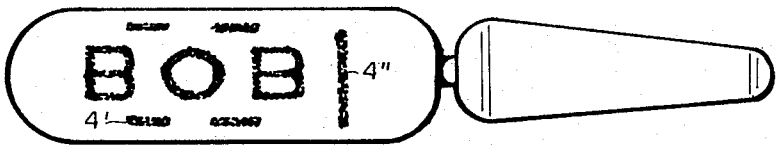
Figure 1:
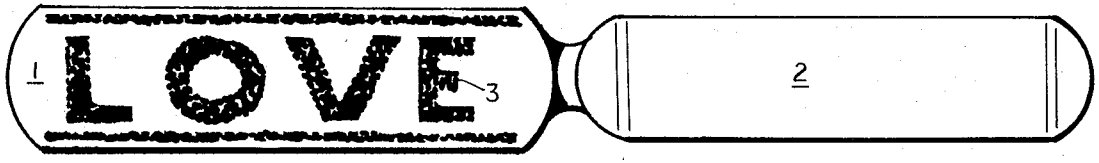
FIG. 1 is a view of the brush in accordance with the present invention, from the front.
Figure 2:
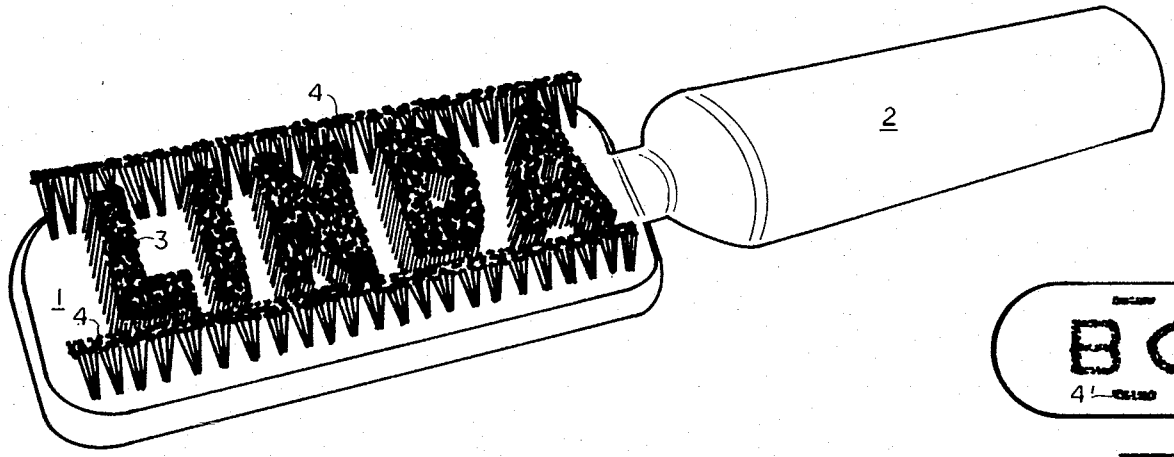
FIG. 2 is a perspective view of the brush in accordance with the present invention.

For the same purpose of complete overlapping additional rows of bristles can be formed as short sets 4' arranged only in the spaces between the letters, numerals and the like, in the longitudinal direction, as shown in FIG. 4. Also, one or several further transverse rows of bristles 4'' can be provided.

The invention is not limited to the details shown since various modifications and structural changes are possible without departing from the idea of the invention.

What is desired to be protected by Letters Patent is set forth in the claims.

I claim:

1. A brush, comprising a supporting portion having an uninterrupted surface with a predetermined outer contour and elongated in a first direction said supporting portion having a portion thereof adapted to be held by a person's hand during use, said surface facing a user;

a plurality of sets of bristles extending beyond said surface and arranged on said supporting portion so that each of said sets of bristles has a contour forming a letter and/or a numeral, and said sets of bristles are spaced from one another so as to form meaningful word and/or expression, only by said bristles and not by said supporting surface; the area of the supporting portion defined by the space between said sets of bristles being devoid of bristles and two rows of bristles extending in said first direction and located at opposite sides of said letters and/or numerals, as considered in a second direction which is transverse to said first direction so as to provide a continuous line of bristles in said first direction and to maintain the brushing effect despite the spaces between said sets of bristles.

2. A brush as defined in claim 1, wherein said letters and/or numerals also have hollow spaces within their contours.

3. A brush as defined in claim 1, wherein each of said rows of bristles includes a plurality of sets of bristles each arranged at one side of said letters and/or numerals between two neighboring letters and/or numerals as considered in said first direction.

4. A brush as defined in claim 1; and further comprising at least one further row of bristles arranged at one side of said letters and/or numerals as considered in said first direction, and extending in a second direction which is transverse to said first direction.

5. A brush as defined in claim 1, wherein said letters and/or numerals are inclined to said first direction so that when seen in a second direction which is transverse to said first direction, said bristles form an uninterrupted line in said first direction.

6. A brush as defined in claim 1, wherein said letters, numerals and the like are composed of bristles of different colors.

7. A brush as defined in claim 1, wherein said additional rows of bristles have a color which is different from the color of said letters and/or numerals.

* * * * *